United States Patent [19]

Davis et al.

[11] Patent Number: 4,614,297

[45] Date of Patent: Sep. 30, 1986

[54] TAMPER RESISTANT CARTON

[75] Inventors: Robert E. Davis, Nutley; Patrick S. Maio, Ringwood, both of N.J.; Lawrence J. Growney, Pearl River, N.Y.

[73] Assignee: Federal Paper Board Co., Inc., Montvale, N.J.

[21] Appl. No.: 613,043

[22] Filed: May 22, 1984

[51] Int. Cl.[4] ..... B65D 5/08

[52] U.S. Cl. ..... 229/132; 229/153; 229/190; 206/807

[58] Field of Search ..... 229/37 R, 38, 39 R, 229/43, 45; 206/247, 491, 631, 633, 807; 220/416, 418

[56] References Cited

U.S. PATENT DOCUMENTS

| | | | |
|---|---|---|---|
| 1,460,124 | 6/1923 | Beam | 229/38 |
| 1,502,606 | 7/1924 | Whelan | 229/38 |
| 2,027,488 | 1/1966 | Ness | 229/38 |
| 2,368,534 | 1/1945 | Forrer | 229/38 |
| 2,670,128 | 2/1954 | Stowitts | 229/38 |
| 2,928,581 | 3/1980 | Graybill | 229/39 R |
| 2,988,261 | 6/1961 | Keating | 229/38 |
| 3,121,524 | 2/1964 | Monot | 229/38 |
| 3,233,818 | 2/1966 | Bixler et al. | 229/45 |
| 3,288,349 | 11/1966 | Palmer et al. | 229/45 |
| 3,365,114 | 1/1968 | Macchi | 229/39 R |
| 3,365,134 | 1/1968 | Oberreich | 229/39 R |
| 3,543,995 | 12/1970 | Wilson | 206/807 |
| 3,606,135 | 9/1971 | Rosenburg, Jr. | 229/43 |
| 3,861,582 | 1/1975 | Bock | 206/807 |
| 4,063,678 | 12/1977 | Hall | 206/807 |
| 4,163,492 | 8/1979 | Rella | 229/38 |
| 4,479,588 | 10/1984 | Davis et al. | 229/38 |

*Primary Examiner*—Joseph Man-Fu Moy
*Assistant Examiner*—David Fidei
*Attorney, Agent, or Firm*—Charles E. Brown; Charles A. Brown

[57] ABSTRACT

This relates to tamper resistant cartons wherein the outermost closure flap is provided with a sealing flap of which at least a portion functions as a tuck flap and which tuck flap passes between a front panel and a terminal inner panel with a tuck flap portion being bonded on its inner surface to the outer surface of the inner terminal panel in an inaccessible position whereby the carton cannot be opened without rupturing the same to the extent that tampering would be apparent.

20 Claims, 15 Drawing Figures

80
2
1
74
62
66
68
52
38
60
54
94
22
26

68
66
62
26
46
80
3
84
92
30

20
58
56
46
54
60
59
44
72
62
70
38
40
42
61
68
34
36
66
64
76
74
30
32
82
88
84
86
92
80
90
50
28
24
98
100
94
96
26
22
48

TAMPER RESISTANT CARTON

In response to recent tamper scares, there have been developed cartons which are tamper resistant, i.e. cartons which cannot be opened and then reglued without there being evidence of such tampering.

The initially developed tamper resistant cartons have proven practical, but require more board than ordinary cartons. It is now proposed to make further improvements in tamper resistant cartons wherein lesser board is required to produce such cartons.

With the above and other objects in view that will hereinafter appear, the nature of the invention will be more clearly understood by reference to the following detailed description, the appended claims and the several views illustrated in the accompanying drawings.

Figure 1:
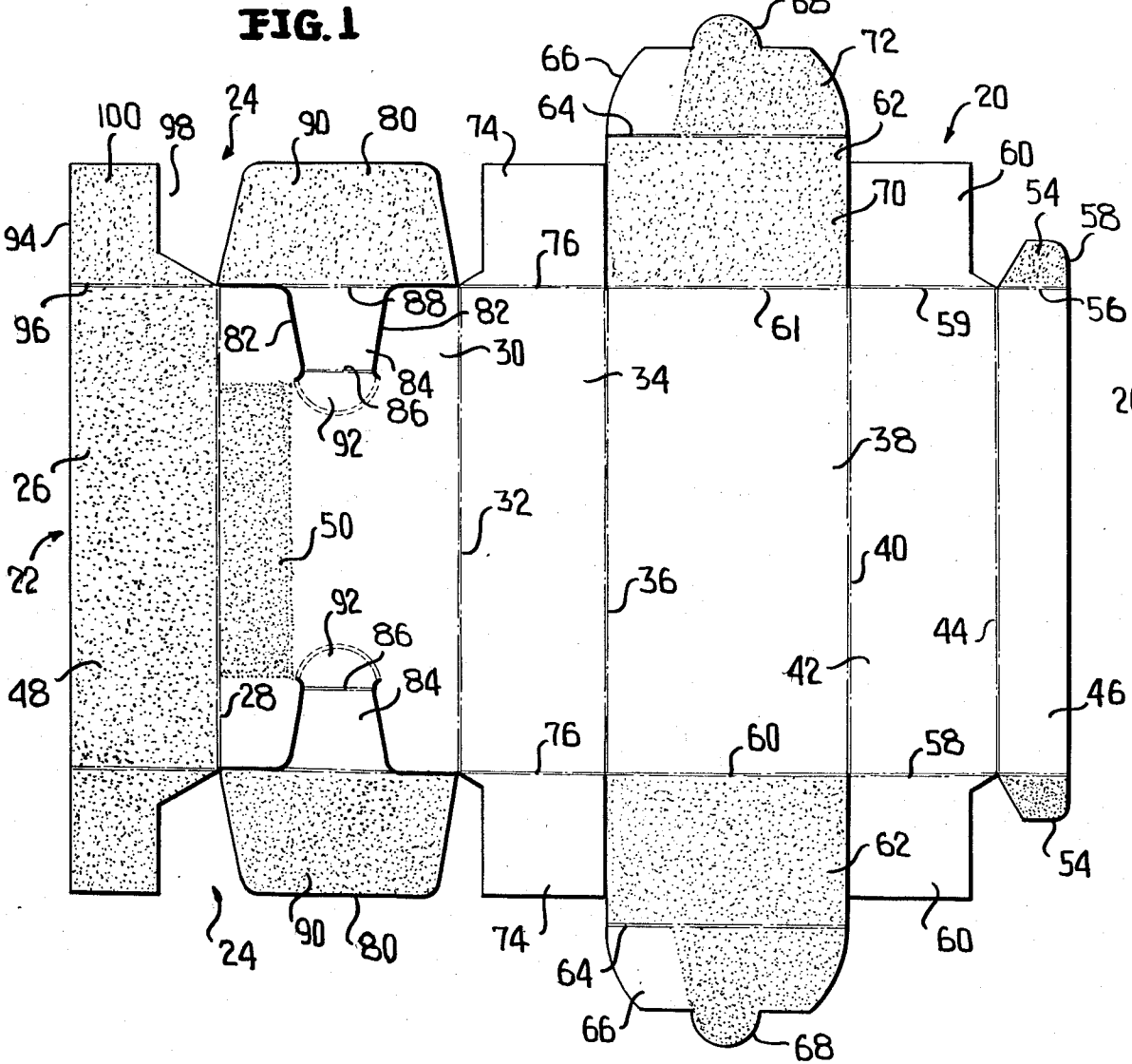
FIG. 1 is a plan view of a blank of an approved form of tamper resistant carton.

Referring now to the drawings in detail, reference is made to FIG. 1 wherein there is illustrated a carton blank formed in accordance with the invention, the carton blank being generally identified by the reference numeral 20.

The blank 20 is divided by two longitudinal fold lines into a central body portion 22 and a pair of mirror image end closure portions 24. The body portion 12 includes an outer terminal panel 26 which is connected along a transverse fold line 28 to a front panel 30. The front panel 30 is connected along a transverse fold line 32 to a side panel 34 which, in turn, is connected along a transverse fold line 36 to a rear panel 38. The rear panel 38 is connected along a transverse fold line 40 to a second side panel 42 which has connected thereto along a transverse fold line 44 an inner terminal panel 46. The inner terminal panel 46 may be best termed as a glue flap.

As will be apparent from FIG. 1, the inner surface of the outer terminal panel 26 is provided with a coating of adhesive 48. Also, the inner surface of the front panel 30 is provided with an adhesive coated area 50 which correspondes to a major part of the central portion of the glue flap 46. Thus when the body of the carton is assembled, the outer terminal panel 26 will overlap substantially the entire width of the side panel 38 and be bonded thereto utilizing the adhesive 48. The glue flaps 46 will be disposed inwardly of the front panel 30 and will have the central part thereof bonded to the rear surface of the front panel 30 utilizing the adhesive 50.

Referring once again to FIG. 1, it will be seen that the blank 20 includes a closure flap 54 connected to each end of the glue flap 46 along a longitudinal fold line 56. The closure flap 54 will have an adhesive 58 on the inner surface thereof.

The side panel 42 carries at each end thereof a closure flap 60 which is connected thereto along a longitudinal fold line 59. In a like manner, the rear panel 38 has connected to each end thereof along a longitudinal fold line 61 a closure flap 62. Each closure flap 62 has hingedly connected thereto along a longitudinal fold line 64 a tuck panel 66. The tuck panel carries a projecting ear 68. It is to be noted that the closure flap 62 has a coating of adhesive 70 while a major portion of the tuck flap 66 and the ear 68 is provided with an adhesive coating 72.

The side panel 34 has connected to opposite ends thereof closure flaps 74 which are connected to the side panel 34 along transverse fold line 76. At each end of the front panel 30 is a closure flap 80. At this time, it is to be noted that each end of the front panel 30 is provided with a pair of diverging cut lines 82 which extend to the closure flap 80 and then turn generally at right angles to divide remote portions of the closure flap 80 from the front panel 30. The cut lines 82 define therebetween a hinge panel 84 which is connected to the remainder of the front panel 30 along a longitudinal fold line 86. Each closure flap 80 is carried by its associated hinge panel 84 and is connected thereto along a longitudinal fold line 88. Further, each closure flap 80 is provided on the inner face thereof with a coating of adhesive 90.

At the inner end of each of the hinge panels 84 immediately adjacent the respective fold line 86, the front panel 30 is provided with a recessed area 92.

Finally, at each end of the outer terminal panel 26 there is a closure flap 94 which is connected to the terminal panel 48 along a longitudinal fold line 96. The closure flap 94 is notched out as at 98 so as to be generally L-shaped and is provided with a coating of adhesive 100.

Figure 2:
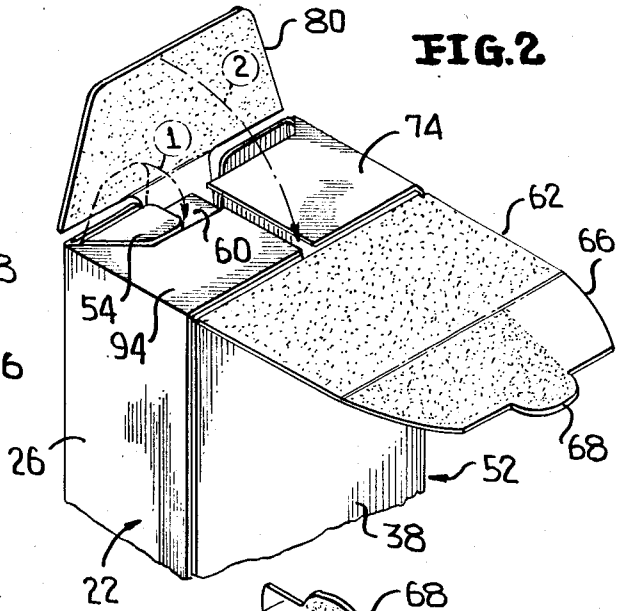
FIG. 2 is a fragmentary top perspective view of a carton formed from the blank of FIG. 1 with the end closure thereof partially formed.
Figure 6:
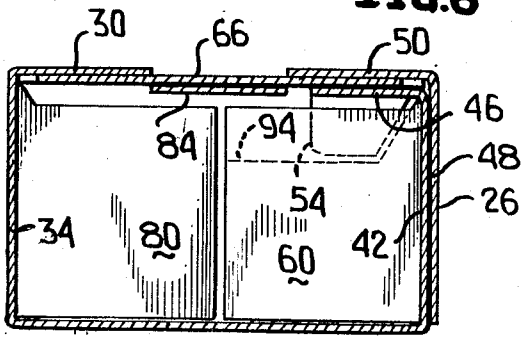
FIG. 6 is a horizontal sectional view taken generally along the line 6—6 of FIG. 4 and shows further the construction of the end closure.

After the body portion 22 of the carton 52 has been formed by folding the body panels relative to one another as shown in FIG. 6 and by adhesively bonding the glue flaps 46 to the inner surface of the front panel 30 and the outer terminal panel 26 to the outer surface of the side panel 42, the ends of the carton 52 are closed as is best shown in FIGS. 2–6. First, it is to be understood that each closure flap 94 will be adhesively bonded to the respective closure flaps 60 at the time the outer terminal panel 26 is bonded to the side panel 42. The thus bonded together closure flaps 60 and 94 are folded to define an end closure forming position as is shown in FIG. 2. The closure flap 74 is also folded over at the same time.

Next, the closure flap 54 is folded into overlying relation to the closure flap 60 and is generally seated in a notch 98 so that the combination of the closure flaps 54, 60 and 94 will be only a double thickness.

Figure 3:
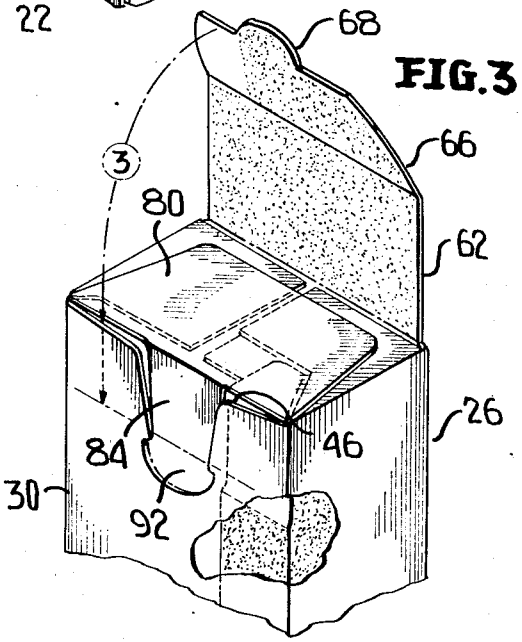
FIG. 3 is another fragmentary top perspective view similar to FIG. 2 but rotated 90° therefrom and shows the end closure in its final stage of formation.

The closure flap 80 is then folded into overlying relation to the previously folded closure flaps and is adhesively bonded to the closure flaps 54, 74 and 94. The end of the carton now appears as shown in FIG. 3.

The closure flap 62 is then folded down into overlying relation to the closure flap 80 and bonded thereto while the tuck flap 66 is tucked down in front of the hinge panel 84 through the openings defined by the cut lines 82. At this time a part of the tuck flap 66 passes between the front panel 30 and the inner terminal panel 46. The tuck flap 66 is bonded to the hinge panel 84 and the outer surface of the end portion of the tuck flap 46 utilizing adhesive 72.

Finally, the ear or tab 68 is seated in the recess 92 and bonded to the outer surface of the underlying portion of the front panel 30.

Figure 4:
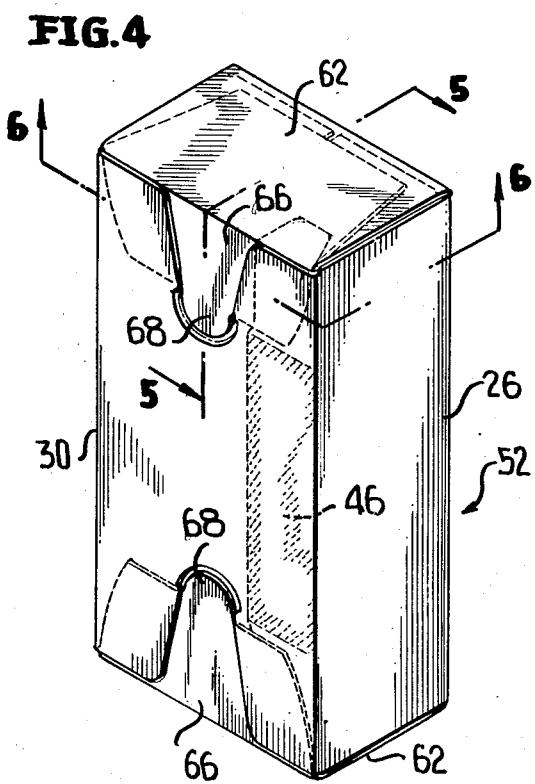
FIG. 4 is a top perspective view similar to FIG. 3 showing the completed carton.

The thus completed carton 52, as is clearly shown in FIG. 4, is completely resistant to tampering. It is virtually impossible to separate the tuck flap 66 from the hinge panel 84. At the same time, one cannot gain access to the bond between the inner surface of the tuck flap 66 and the outer surface of the glue flap or inner terminal panel 46. Access to the interior of the carton through the body portion 22 is also prevented by the large overlap between the outer terminal panel 26 and the side panel 42.

Figure 7:
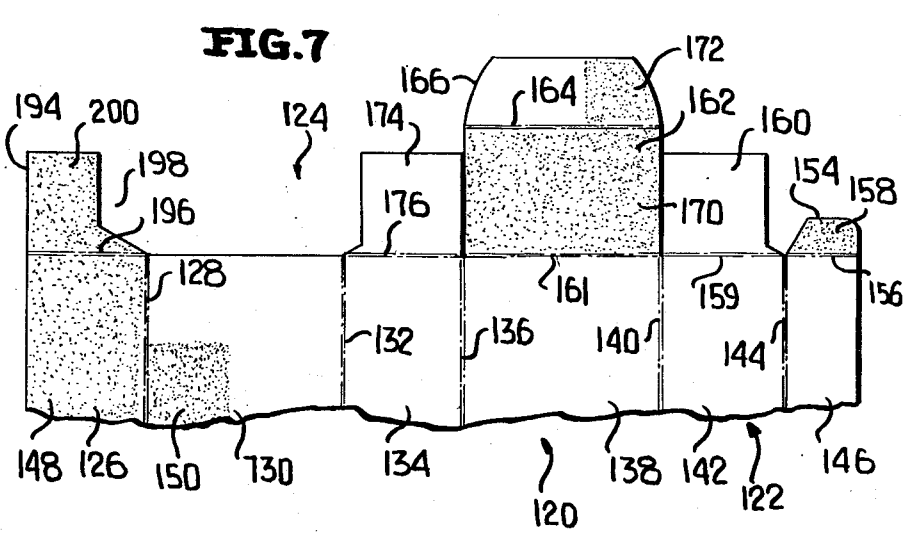
FIG. 7 is a fragmentary plan view of a blank for a modified form of carton.
Figure 8:
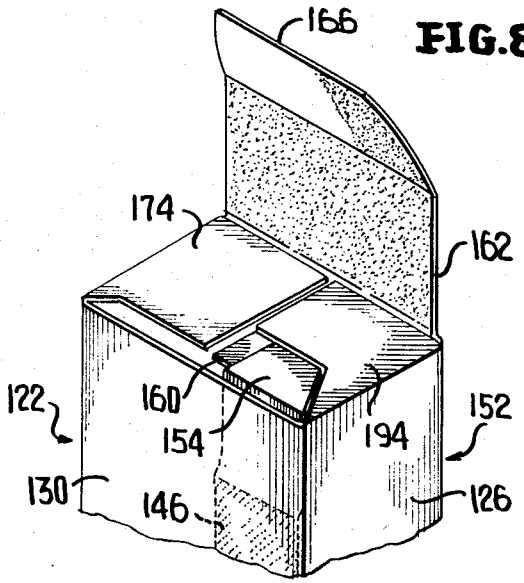
FIG. 8 is a fragmentary top perspective view of a carton formed from the blank of FIG. 7 in its partially closed state.
Figure 9:
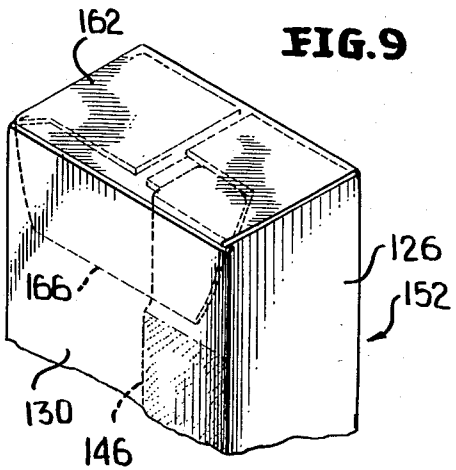
FIG. 9 is a fragmentary top perspective view similar to FIG. 8 and shows the carton in its closed state.
Figure 5:
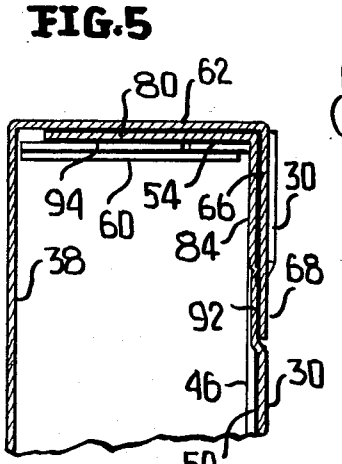
FIG. 5 is an enlarged fragmentary vertical sectional view taken generally along the line 5—5 of FIG. 4 and shows the specific construction of the end closure.

Reference is now made to FIGS. 7, 8 and 9 wherein a modified form of carton and the blank for forming the same are shown. With particular reference to FIG. 7, it will be seen that there is illustrated a carton blank 120 which includes a central body forming portion 122. The blank 120 has two end closure forming portions 124 of which only one is shown.

The body forming portion 122 is very similar to that of the carton blank 20 and includes an outer terminal panel 126 to which there is connected along a transverse fold line 128 a front panel 130. The front panel 130 has connected thereto along a transverse fold line 132 a side panel 134 to which there is connected along a transverse fold line 136 a rear panel 138. At the opposite edge of the rear panel 138 is a transverse fold line 140 along which a side panel 142 is connected to the rear panel 138. Finally, an inner terminal panel or glue flap 146 is connected to the side panel 142 along a transverse fold line 144.

From the foregoing, it will be seen that the carton body forming portion 122 of the blank 120 is identical to that of the blank 20 except for the absence of the cut lines 82 and the recess 92 in the front panel.

The outer terminal panel 126 is provided with an adhesive coating 148 on the inner surface thereof while the inner surface of the front panel 130 is provided with an adhesive coating 150.

The end closure arrangement 124 at each end of the carton blank 120 includes a flap 154 which is connected to the inner terminal panel 146 along a longitudinal fold line 156. The closure flap 154 is provided with a coating of adhesive 158.

The side panel 142 has at its end a longitudinal fold line 159 along which a closure flap 160 is connected to the side panel 142. At the end of the rear panel 138 is a longitudinal fold line 161 along which there is hingedly connected a closure flap 162 to which there is hingedly connected along a longitudinal fold line 164 a tuck flap 166. The closure flap is provided with an overall coating of adhesive 170 while a portion only of the tuck flap 166 is provided with an adhesive coating 172.

A closure flap 174 is connected to the side panel 134 along a longitudinal fold line 176. Finally, a closure flap 194 is connected to each end of the outer terminal panel 126 along a longitudinal fold line 196. The closure flap 194 is notched as at 198 and is provided with a coating of adhesive 200.

A carton 152 is formed from the carton blank 120. The body portion 122 of the carton 152 is formed in the manner described above with respect to the carton body portion 22 of the carton 52. Then the end closures at the opposite ends of the carton body portion 122 are formed. They are formed by folding the flaps in identically the manner described with respect to the carton 52. However, it will be seen that the tuck flap 166 when folded in place merely is disposed inwardly of the front panel 130 and is adhesively bonded only to the outer face of that portion of the inner terminal panel 146 which is not bonded to the inner face of the front panel 130.

Although the carton 152 is not as complex as the carton 52, it will be seen that the bond between the inner face of the tuck flap 166 and the outer face of the glue flap 146 is not accessible to the public and therefore notwithstanding the simplicity of the end closure construction, one cannot tamper with the carton 152 without giving evidence to such tampering.

Figure 10:
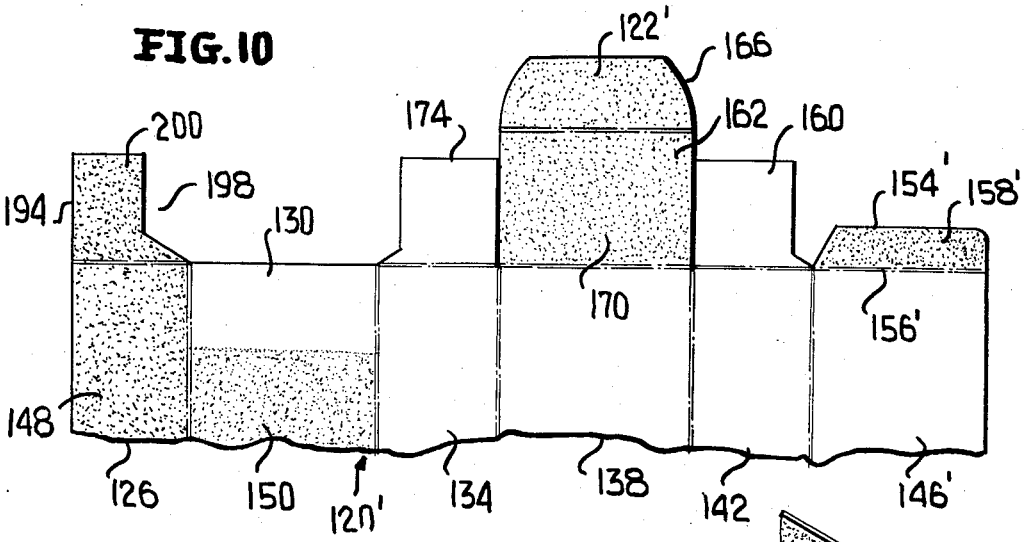
FIG. 10 is a fragmentary plan view of still another form of the carton of FIG. 7 and shows the general details thereof.
Figure 11:
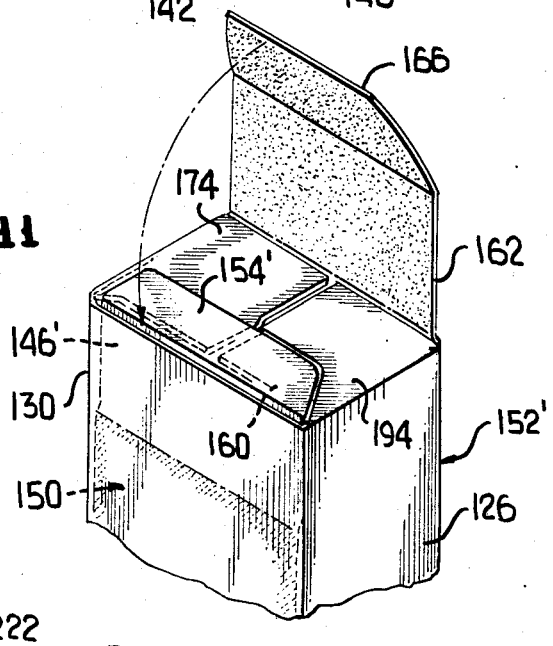
FIG. 11 is a top perspective view of a carton formed from the blank of FIG. 10 with the carton being partially closed.
Figure 12:
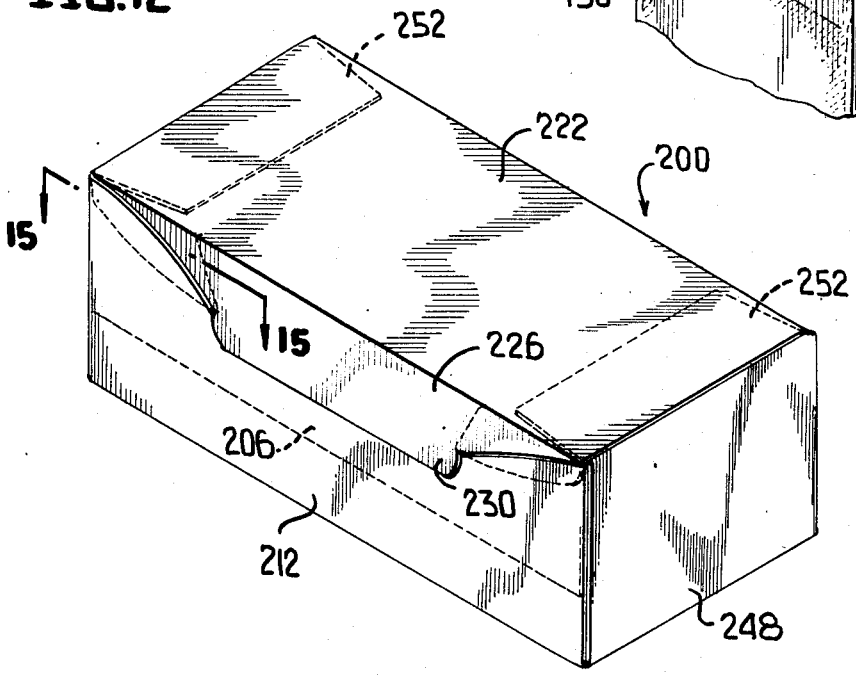
FIG. 12 is a top perspective view of yet another form of carton in accordance with the invention.

Reference is now made to FIGS. 10 and 11 wherein there is illustrated a slightly modified form of carton identified by the reference numeral 152' which is formed from the carton blank of FIG. 10, generally identified by the numeral 120'. The carton blank 120' and the resultant carton 152' differ from the carton 152 and the carton blank 120 only in the widths of the inner terminal panel and the closure flaps carried thereby. Accordingly, with the exception of this panel and those two flaps, the same reference numerals apply to the blank of FIG. 7 and the carton of FIGS. 8 and 9 will be applied to the blank of FIG. 10 and the carton of FIG. 11.

Should the tamper resistance of the carton 152 of FIGS. 8 and 9 be questioned, by utilizing slightly additional board in the formation of the blank 120', the inner terminal panel 146' may be made of a greater width than that utilized for the customary glue flap. Further, the closure flaps 154' at each end of the inner terminal panel 146' will be wider and will be connected to the inner terminal panel 146' along the longitudinal fold line 156'. In addition, adhesive 158' will be applied to the inner surface of the closure flaps 154'.

A further modification over the blank 120 is that the tuck panel 166 will have an overall coating of adhesive 172'.

It will be seen that FIG. 11 corresponds with FIG. 8 except for the increased width in the inner terminal panel 146' which is of a width substantially equal to the width of the front panel 130. The tuck panel 166, when inserted between the non-bonded together portions of the front panel 130 and the inner terminal panel 146', will have a substantially complete bonding to the outer surface of the inner terminal panel 146' thus assuring security of the end closure.

Figure 13:
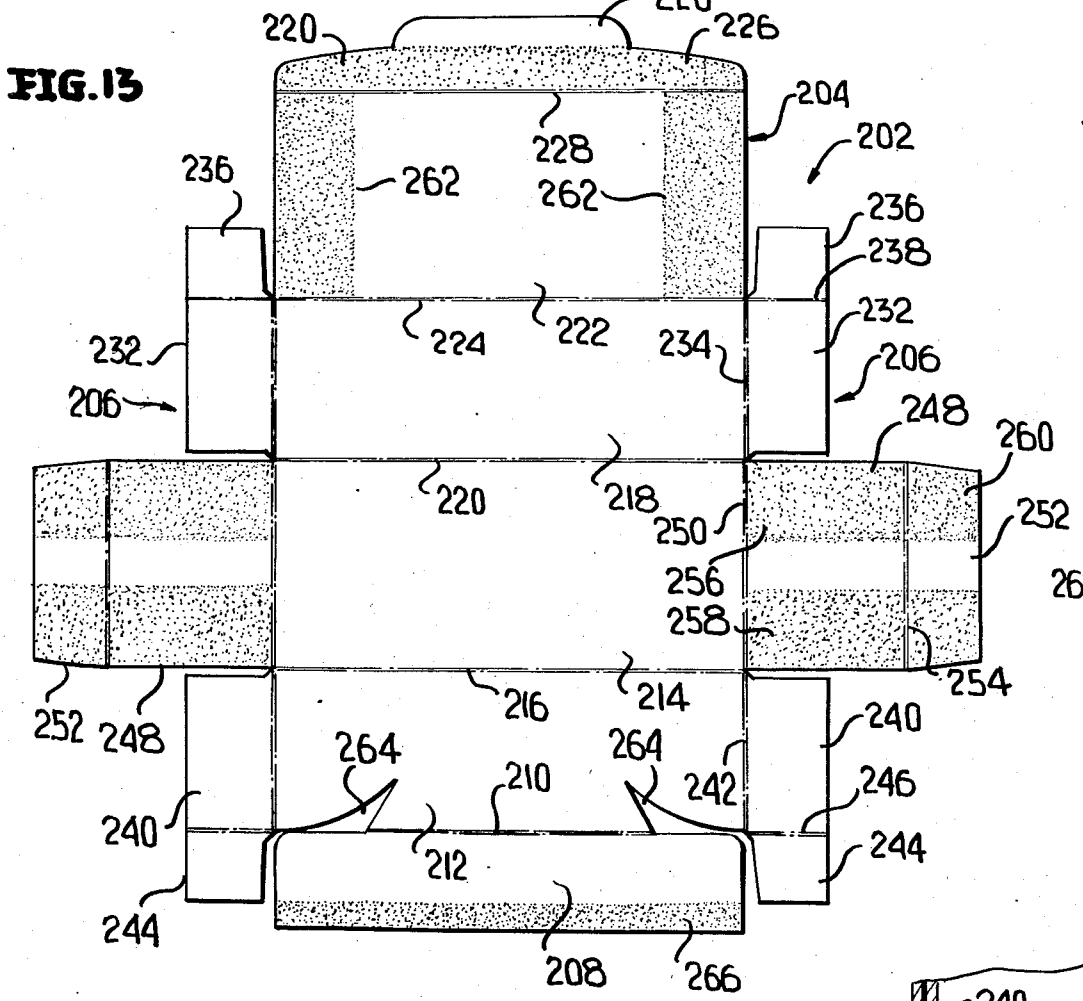
FIG. 13 is a plan view of the blank from which the carton of FIG. 12 is formed.

Reference is now made to FIGS. 12–15 wherein there is illustrated yet another form of carton generally identified by the numeral 200. The carton 200 is different from the cartons of FIGS. 1–11, but employs the same principle of tamper resistance. The carton 200 is a relatively elongated carton which may be utilized for packaging cookies and the like. Referring now to FIG. 13, it will be seen that there is illustrated a carton blank 202 which includes a central body forming portion 204 and a pair of end closure forming portions 206.

The body forming portion 204 includes an inner terminal panel 208 to which there is connected along a longitudinal fold line 210 a front panel 212. Next to the front panel 212 is a bottom panel 214 which is connected to the front panel along a longitudinal fold line 216. A rear panel 218 is connected to the bottom panel 214 along a longitudinal fold line 220. A top panel 222 is connected to the rear panel 218 along a longitudinal fold line 224. The top panel 222, which may be considered a closure flap, carries a front closure flap 226 which is connected thereto along a longitudinal fold line 228. The flap 226 may be considered a tuck flap for reasons which will be apparent hereinafter. The flap 226 carries an opening tab 230.

Each end closure arrangement 206 includes an end flap 232 which is connected to a respective end of the rear panel 218 along a transverse fold line 234. Each flap 234 carries a top closure flap 236 which is connected to the flap 232 along a longitudinal fold line 238.

In a like manner, the front panel 212 has at each end thereof an end closure flap 240 which is connected thereto along a transverse fold line 242. Each flap 240 carries a top closure flap 244 which is connected to the flap 240 along a longitudinal fold line 246.

Finally, at each end of the bottom panel 214 there is an end closure flap 248 which is connected to the bottom panel 214 along a transverse fold line 250. Each flap 248 carries a top closure flap 252 which is connected thereto along a transverse fold line 254.

In order that the flaps 232, 240 may be adhesively bonded to the flaps 248, the flaps 248 have two areas 256, 258 coated with an adhesive. In a like manner, the flaps 252 are coated with an adhesive 260. Finally, in order that the top panel 222 may be bonded to the flaps 252, the top panel is provided with areas 262 which are coated with an adhesive.

At this time it is also pointed out that the front panel 212 has cutouts 264 adjacent the opposite ends thereof and adjacent the fold line 210. The purpose of these cutouts will be set forth in more detail hereinafter.

Figure 14:
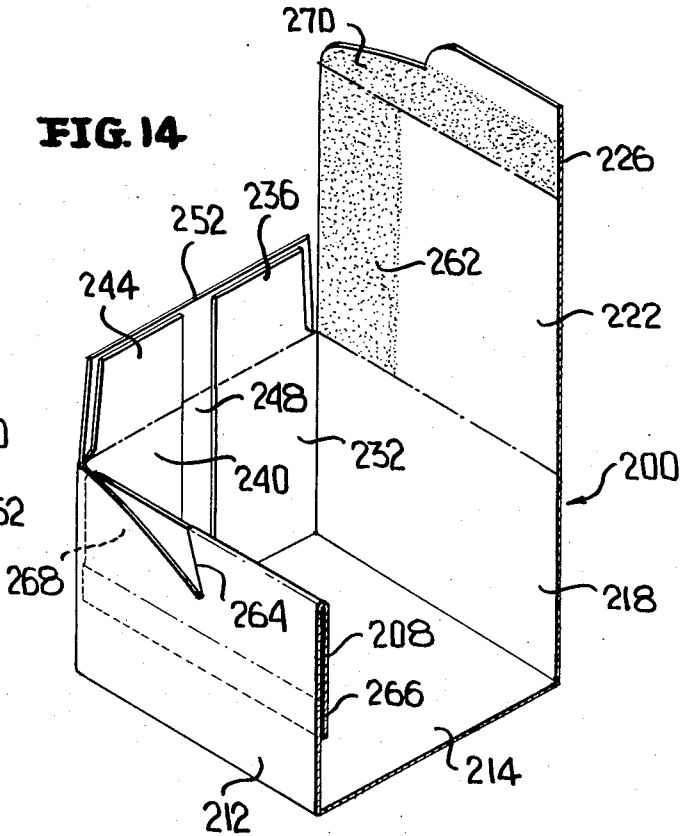
FIG. 14 is a fragmentary top perspective view of the carton of FIG. 12 prior to the closing thereof.
Figure 15:
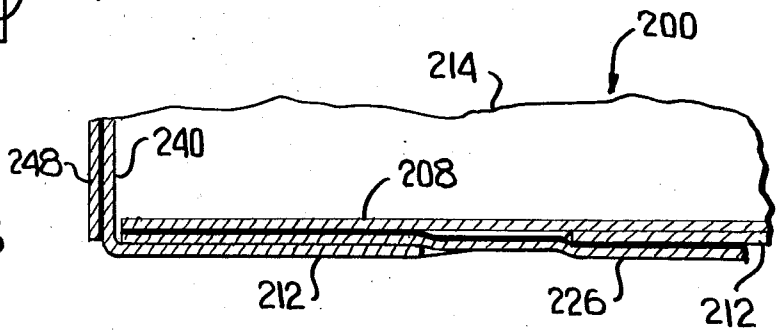
FIG. 15 is a fragmentary horizontal sectional view taken generally along the line 15—15 of FIG. 12 and shows specifically the details of the closure of the carton.

With reference to FIG. 14, it will be seen that when the front panel 212 and the rear panel 218 are folded to upright positions relative to the bottom panel 214, and the end closure flaps 248 are moved to upstanding positions, the carton 200 is essentially formed. However, the flaps 232, 240 must be bonded to the flaps 248 and the flaps 236, 244, must be bonded to the flaps 252.

The inner terminal panel 208, which is provided with a layer of adhesive 266 along the free edge thereof, is folded inwardly of the front panel 212 and is adhesively bonded thereto as shown in FIG. 14. Since those portions of the front panel 212 having formed therein the cutouts 264 are not bonded to the inner terminal panel 208, it will be seen that there is defined between the front panel 212 and the inner terminal panel 208 at opposite ends of the top portion of the front panel 212 pockets 268.

After the carton 200 has been erected to the shape previously described, the closure flaps 252 are folded to horizontal positions together with the flaps 236 and 244, after which the top panel or closure flap 222 is folded down. At this time the tuck flap 226, which has a layer of adhesive 270 thereon has the opposite ends thereof tuck into the pockets 268 and the inner surface of the tuck flap 226 is bonded to the then outer surface of the inner terminal panel 208 in an area which is non-accessible from the exterior of the carton. The central portion of the tuck flap 226 is also bonded to the outer face of the front panel 212.

The net result is a carton which cannot be opened without giving evidence of tampering. On the other hand when it is desired to open the carton, the tab 230 may be grasped and pulled upwardly so as to tear open the carton in a manner wherein the carton can be generally resealed.

Although only several preferred embodiments of tamper resistant cartons have been specifically illustrated and described herein, it is to be understood that minor variations may be made in the carton without departing from the spirit and scope of the invention as defined by the appended claims.

We claim:

1. A tamper resistant carton comprising a body and at least one sealed openable end; said body comprising front and rear panels and at least two opposite side panels, and inner and outer terminal panels, said outer terminal panel overlapping one of said side panels for at least substantially the full width of said one side panel and having an overall bond with said one side panel, said inner terminal panel being disposed inwardly of said front panel and having at least a central portion thereof bonded to an inner surface of said front panel, an end portion of said inner terminal panel adjacent said one sealed openable end of said carton being free of said front panel and defining a space between said inner terminal panel and said front panel opening axially at said one carton end; said one sealed openable end including a closure flap carried by said rear panel, and a tuck flap carried by said closure flap, said tuck flap being positioned inwardly of said front panel with at least a portion of said tuck flap being positioned in said space between said inner terminal panel and said front panel, said tuck flap having an inner surface bonded to an adjacent portion of the outer surface of said inner terminal panel in a non-accessible position whereby said one sealed openable end can be opened only by rupturing at least one of said panels or flaps, said inner terminal panel being a partial panel and generally in the form of a glue flap foldably carried by one of said side panels.

2. The tamper resistant carton of claim 1 wherein said one sealed openable end includes an end flap carried by each of said side panels and said terminal panels, said outer terminal panel end flap overlying said end flap of said one side panel and having a relieved edge portion facing said inner terminal panel defining a notch, and said inner terminal panel end flap being seated in said notch and overlying and being boned to said one side panel end flap.

3. A tamper resistant carton comprising a body and at least one sealed openable end; said body comprising front and rear panels and at least two opposite side panels, and inner and outer terminal panels, said outer terminal panel overlapping one of said side panels for at least substantially the full width of said one side panel and having an overall bond with said one side panel, said inner terminal panel being disposed inwardly of said front panel and having at least a central portion thereof bonded to an inner surface of said front panel, an end portion of said inner terminal panel adjacent said one sealed openable end of said carton being free of said front panel and defining a space between said inner terminal panel and said front panel opening axially at said one carton end; said one sealed openable end including a closure flap carried by said rear panel, and a tuck flap carried by said closure flap, said tuck flap being positioned inwardly of said front panel with at least a portion of said tuck flap being positioned in said space between said inner terminal panel and said front panel, said tuck flap having an inner surface bonded to an adjacent portion of the outer surface of said inner terminal panel in a non-accessible position whereby said one sealed openable end can be opened only by rupturing at least one of said panels or flaps, said one sealed openable end includes an end flap carried by each of said side panels and said terminal panels, said outer terminal panel end flap overlying said end flap of said one side panel and having a relieved edge portion facing said inner terminal panel defining a notch, and said inner terminal panel end flap being seated in said notch and overlying and being bonded to said one side panel end flap.

4. The tamper resistant carton of claim 1 wherein said inner terminal panel is generally a full width panel.

5. The tamper resistant carton of claim 4 wherein said one sealed openable end includes an end flap carried by each of said side panels and said terminal panels, said outer terminal panel end flap overlying said end flap of said one side panel and having a relieved edge portion facing said inner terminal panel defining a notch, and said inner terminal panel end flap being seated in said notch and overlying and being bonded to said one side panel end flap.

6. The tamper resistant carton of calim 5 wherein said inner terminal panel end flap also overlies and is bonded to said end flap of the other of said side panels.

7. The tamper resistant carton of claim 1 wherein said one sealed openable end includes an end flap carried by said front planel, said front panel end flap being carried solely by a free hinge flap formed of a central part of said front panel, and that portion of said tuck flap located outwardly of said front panel lying outwardly of said hinge flap with said inner surface of said tuck flap being bonded to said hinge flap.

8. The tamper resistant carton of claim 7 wherein said hinge flap has an end thereof remote from said one sealed openable end integrally connected to said front panel.

9. The tamper resistant carton of claim 8 wherein said front panel is inwardly recessed to form a seat in alignment with and at said end of said hinge flap, and said tuck flap has an opening tab seated in said seat.

10. The tamper resistant carton of claim 7 wherein said inner terminal panel is a partial panel foldably carried by one of said panels and generally in the form of a glue flap.

11. The tamper resistant carton of claim 1 wherein said one sealed openable end includes an end flap carried by each of said side panels and said terminal panels, said outer terminal panel end flap overlying said end flap of said one side panel and having a relieved edge portion facing said inner terminal panel defining a notch, and said inner terminal panel end flap being seated in said notch and overlying and being bonded to said one side panel end flap.

12. A tamper resistant carton comprising a body and at least one sealed openable end; said body comprising front and rear panels and at least two opposite side panels, said front panel having at at least an upper portion thereof an overlapping inner panel, said inner panel having an upper portion free of said front panel and a portion below said upper portion bonded to said front panel; said one sealed openable end including a closure flap extending forwardly from a top end of said rear panel, and a tuck flap extending downwardly from said closure flap at said front panel, said tuck flap having at least a portion thereof tucked between said inner panel and said front panel and having an inner surface thereof bonded to an outer surface of said inner panel, said inner panel being an inner terimal panel, said inner terminal panel being a partial panel foldably carried by one of said side panels and generally in the form of a glue flap.

13. The tamper resistant carton of claim 12 wherein there is an outer terminal panel overlapping and bonded to one of said panels, said one sealed openable end includes an end flap carried by each of said side panels and said terminal panels, said outer terminal panel end flap overlying said end flap of said one side panel and having a relieved edge portion facing said inner terminal panel defining a notch, and said inner terminal panel end flap being seated in said notch and overlying and being bonded to said one side panel end flap.

14. A tamper resistant carton comprising a body and at least one sealed openable end; said body comprising front and rear panels and at least two opposite side panels, said front panel having at at least an upper portion thereof of overlapping inner panel, said inner panel having an upper portion free of said front panel and a portion below said upper portion bonded to said front panel; said one sealed openable end including a closure flap extending forwardly from a top end of said rear panel, and a tuck flap extending downwardly from said closure flap at said front panel, said tuck flap having at least a portion thereof tucked between said inner panel and said front panel and having an inner surface thereof bonded to an outer surface of said inner panel, said inner panel being an inner terminal panel, a portion of said front panel adjacent said one sealed openable end being relieved with side edge portions of said tuck flap being inwardly of said front panel and a central portion of said tuck flap between said side edge portions being located outwardly in front of a central portion of said front panel.

15. The tamper resistant carton of claim 14 wherein said relieved portion of said front panel is centrally located.

16. The tamper resistant carton of claim 14 wherein there are two relieved portions of said front panel, one relieved portion adjacent each side edge of said front panel.

17. The tamper resistant carton of claim 14 wherein said terminal panel is hingedly connected to a top edge of said front panel and has a lower terminal edge.

18. The tamper resistant carton of claim 17 wherein there are two relieved portions of said front panel, one relieved portion adjacent each edge of said front panel, said tuck flap has corners thereof tucked into said relieved portions behind said front panel, and a central portion of said tuck flap is positioned in front of and secured to a front face of said front panel.

19. A tamper resistant carton comprising a body and at least one sealed openable end; said body comprising front and rear panels and at least two opposite side panels, and inner and outer terminal panels, said outer terminal panel overlapping one of said side panels for at least substantially the full width of said one side panel and having an overall bond with said one side panel, said inner terminal panel being disposed inwardly of said front panel and having at least a central portion thereof bonded to an inner surface of said front panel, an end portion of said inner terminal panel adjacent said one sealed openable end of said carton being free of said front panel and defining a space between said inner terminal panel and said front panel opening axially at said one carton end; said one sealed openable end including a closure flap carried by said rear panel, and a tuck flap carried by said closure flap, said tuck flap being positioned inwardly of said front panel with at least a portion of said tuck flap being positioned in said space between said inner terminal panel and said front panel, said tuck flap having an inner surface bonded to an adjacent portion of the outer surface of said inner terminal panel in a non-accessible position whereby said one sealed openable end can be opened only by rupturing at least one of said panels or flaps, and a portion of said tuck flap is located outwardly in front of said front panel.

20. The tamper resistant carton of claim 19 wherein said inner terminal panel is a partial panel foldably carried by one of said side panels and generally in the form of a glue flap.

* * * * *